US006283517B1

(12) United States Patent
Nazzari

(10) Patent No.: US 6,283,517 B1
(45) **Date of Patent: *Sep. 4, 2001**

(54) ONE-PIECE SECURITY SEAL

(75) Inventor: Ian Nazzari, Moraga, CA (US)

(73) Assignee: NIC Products Inc., Walnut Creek, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/059,360

(22) Filed: Apr. 14, 1998

Related U.S. Application Data

(63) Continuation of application No. 08/686,584, filed on Jul. 26, 1996, now Pat. No. 5,782,513.

(51) Int. Cl.[7] ..... G09F 3/03; B65D 27/30

(52) U.S. Cl. ..... 292/321; 292/322; 292/307 B

(58) Field of Search ..... 292/307 R, 307 A, 292/307 B, 321, 317–319, 322, 326; 24/16 PB, 30.5 R, 17 A, 18

(56) References Cited

U.S. PATENT DOCUMENTS

| | | | | |
|---|---|---|---|---|
| 210,641 | * | 12/1878 | Smith . | |
| 1,059,689 | | 4/1913 | Webb . | |
| 1,381,975 | * | 6/1921 | Dumais . | |
| 1,647,398 | * | 11/1927 | Draheim | 24/18 |
| 1,727,754 | * | 9/1929 | Dessaver . | |
| 1,945,965 | * | 2/1934 | Behrman . | |

(List continued on next page.)

FOREIGN PATENT DOCUMENTS

| | | | | |
|---|---|---|---|---|
| 2 262 421 | | 12/1972 | (DE) . | |
| 2262421 | * | 7/1973 | (DE) | 292/320 |
| 2 168 654 | | 6/1986 | (GB) . | |
| 2168654 | * | 6/1986 | (GB) | 292/320 |
| 660127 | * | 1/1964 | (IT) | 292/317 |
| 242473 | * | 5/1946 | (SE) | 292/317 |

*Primary Examiner*—Gary W. Estremsky
(74) *Attorney, Agent, or Firm*—Bacon & Thomas, PLLC

(57) ABSTRACT

A one-piece security seal is provided which has a superior ergonomic design making the seal easier to put into place and lock. The seal comprises a capsule having a wall which defines an open end and a closed end. The capsule includes a first connection fitting formed therein. A first aperture is formed in the wall of the capsule. A second aperture is formed in the wall of the capsule aligned with and opposite the first aperture. A locking member having an insertion end is connected to the capsule by a flexible connecting arm which is integrally formed therewith. The insertion end is insertable into the open end of the capsule such that a bent path is created between the locking member and the capsule when the insertion end is inserted therein. Also, the insertion end includes a second connection fitting which is designed to cooperate with the first connection fitting of the capsule to provide an irreversible connection between the locking member and the capsule when the insertion end is inserted therein. A flexible wire sized to be passable through the first and second apertures is permanently connected to the seal and extends therefrom with a free end. The security seal is locked by passing the free end of the flexible wire through the first and second apertures of the capsule and subsequently inserting the insertion end of the locking member into the open end of the capsule such that the second connection fitting is irreversibly engaged by the first connection fitting and the flexible wire is forced to conform to the bent path to form a plurality of crimps in the flexible wire. Thus, the flexible wire is secured between the capsule and the locking member.

18 Claims, 3 Drawing Sheets

U.S. PATENT DOCUMENTS

| | | | | |
|---|---|---|---|---|
| 1,982,438 | * | 11/1934 | Keidel . | |
| 1,987,737 | | 1/1935 | Goddard | 292/307 |
| 2,809,065 | | 10/1957 | Erke | 292/307 |
| 3,591,223 | | 7/1971 | De Lima Castro Neto | 292/320 |
| 3,736,017 | | 5/1973 | Kaiho | 292/317 |
| 3,954,294 | | 5/1976 | Iwamoto et al. | 292/318 |
| 4,106,801 | | 8/1978 | De Lima Castro Neto | 292/307 R |
| 4,175,782 | | 11/1979 | de Lima Castro Neto | 292/307 R |
| 4,722,562 | | 2/1988 | Burt | 292/318 |
| 4,793,641 | * | 12/1988 | Sokol | 292/322 |
| 4,818,002 | | 4/1989 | De Lima Castro Neto | 292/307 R |
| 4,940,268 | | 7/1990 | Lesquir et al. | 292/317 |
| 4,968,075 | | 11/1990 | Lesquir et al. | 292/321 |
| 5,118,148 | | 6/1992 | De Lima Castro Netto | 292/307 R |
| 5,180,200 | | 1/1993 | Georgopoulos et al. | 292/326 |
| 5,345,657 | * | 9/1994 | Shimuzu | 24/115 |
| 5,348,180 | | 9/1994 | Shepard | 220/214 |
| 5,402,958 | | 4/1995 | Mahaney | 242/388.1 |
| 5,489,034 | | 2/1996 | Netto | 215/212 |
| 5,762,386 | * | 6/1998 | Fuehrer | 292/307 |
| 5,782,513 | * | 7/1998 | Nazzari | 292/319 |
| 5,871,243 | * | 2/1999 | Wenk | 292/320 |

* cited by examiner

FIG. 5
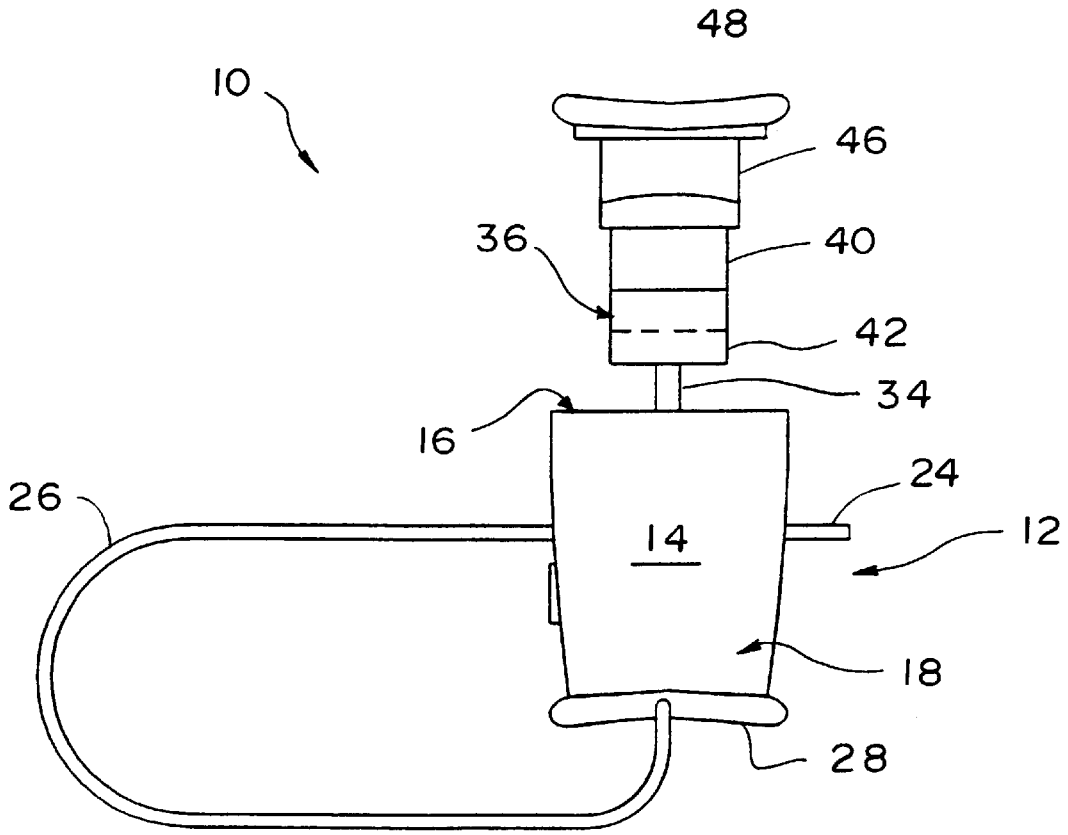
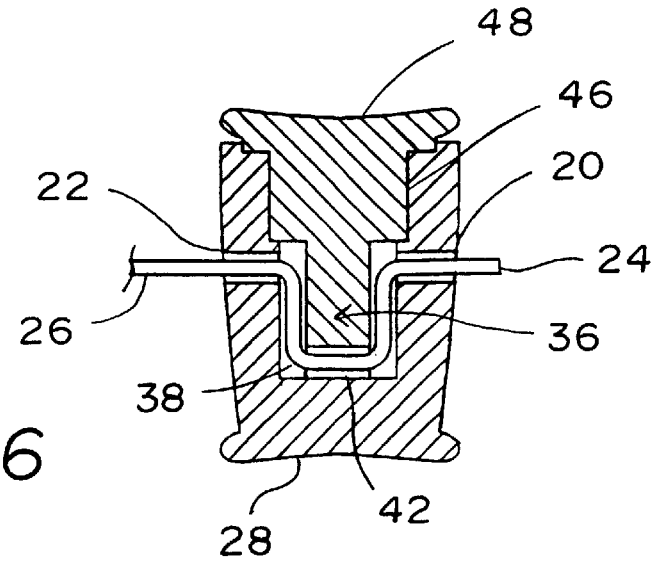
FIG. 6

ONE-PIECE SECURITY SEAL

This application is a continuation of Ser. No. 08/686,584 Jul. 26, 1996 now U.S. Pat. No. 5,782,513.

BACKGROUND OF THE INVENTION

1. Field of the Invention

The invention relates to a one-piece security seal which is often used to secure closure of meter or postal boxes because the seal cannot be opened without being broken, thus providing evidence of tampering. More specifically, the invention relates to such a security seal with a superior ergonomic design which makes the seal easier to put into place and lock.

2. Description of the Related Art

Wire security seals in general are well known having been previously disclosed in patents and put in the public domain. These known wire seals have various designs, most having a stud shaped for nonremovable engagement with a capsule. These known wire seals have several shortcomings. Firstly, they are difficult to close with one hand and particularly with gloved hands. Secondly, the wire may be pulled out and pushed back in without leaving evidence of tampering.

Ref cited:

| | | | |
|---|---|---|---|
| 3,591,223 | 1971 | Castro Neto | 292#320 |
| 4,106,801 | 1978 | Castro Neto | 292#307R |
| 4,175,782 | 1979 | Castro Neto | 292#307R |
| 4,818,002 | 1989 | Castro Neto | 292#307R |
| 4,722,562 | 1988 | Burt | 292#318 |
| 5,180,200 | 1993 | Geogropoulos | 292#326 |
| 5,348,180 | 1994 | Shepard | 220#214 |
| 5,402,958 | 1995 | Mahaney | 242#388.1 |
| 5,489,034 | 1996 | Netto | 215#212 |

SUMMARY OF THE INVENTION

The invention provides a user-friendly one-piece security seal of superior ergonomic design of the type having a capsule and a locking member. The capsule and locking member are connected by an arm. The capsule has apertures through which a wire, which is permanently connected to the security seal, may be threaded.

The apertures are formed in a wall of the capsule which defines an open end and a closed end. A first connection fitting is formed within the capsule. The locking member has an insertion end which is insertable into the open end of the capsule. When the insertion end is inserted into the capsule, a space having a bent path is created between the locking member and the capsule. The insertion end includes a second connection fitting which is designed to cooperate with the first connection fitting of the capsule to provide an irreversible connection between the locking member and the capsule.

The security seal is locked by passing a free end of the wire through the apertures of the capsule and subsequently inserting the insertion end of the locking member into the open end of the capsule such that the second connection fitting is irreversibly engaged by the first connection fitting. This forces the wire to conform to the bent path between the locking member and the capsule and forms a plurality of crimps in the wire whereby the wire is secured between the capsule and the locking member.

This improved seal bears the following ergonomic improvements: it can be closed with one hand; it is internally "self-threading" and thus can be closed by a gloved hand; the wire cannot be pulled out; and, if the wire is cut, it cannot be pushed back in.

BRIEF DESCRIPTION OF THE DRAWINGS

Other features and advantages of the invention will become evident upon review of the following description of the preferred embodiments, with reference to the attached drawings, in which:

FIG. 5 is a side elevation view of the seal according to FIG. 3 in which the wire is passed through the apertures of the capsule; and FIG. 6 is a section view of the seal shown in FIG. 5 in a locked condition.

DETAILED DESCRIPTION OF THE PREFERRED EMBODIMENTS

Figure 1:
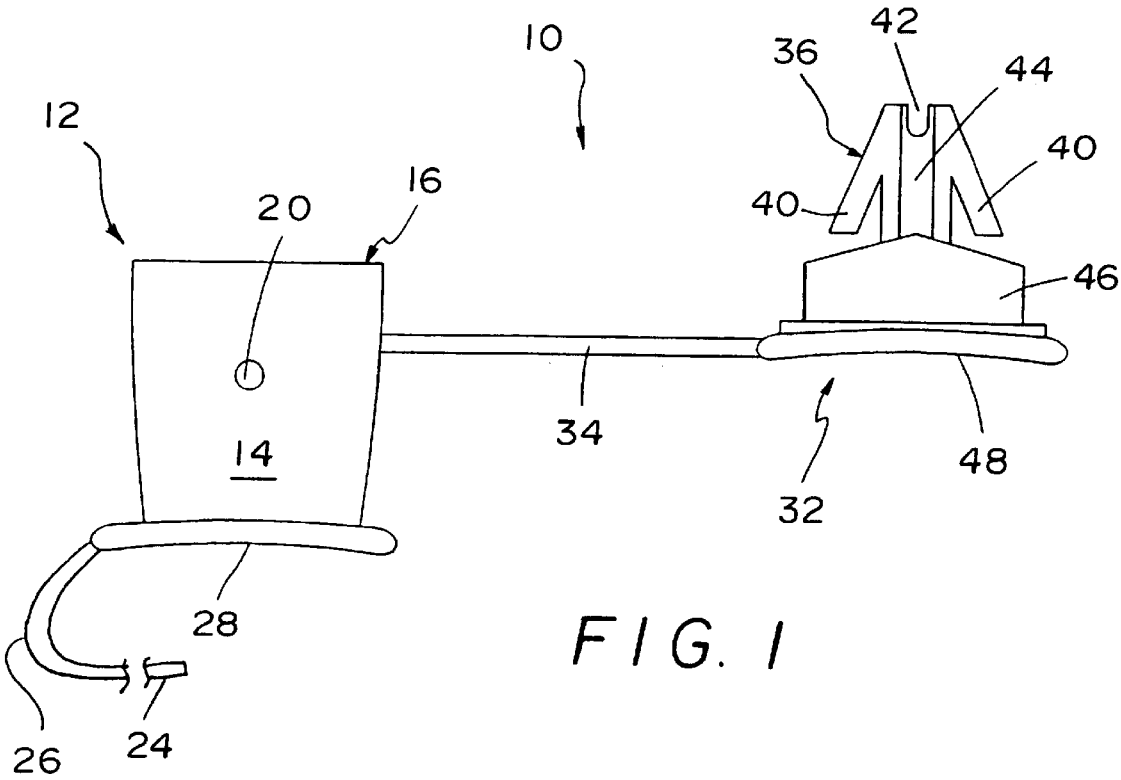
FIG. 1 is a front elevation view of a seal.

A preferred embodiment of a one-piece security seal 10 is shown in FIG. 1. Seal 10 includes a capsule 12 having a wall 14 which defines an open end 16, a closed end 18, and an interior open space 19 between the open and closed ends. A first aperture 20 and a second aperture 22 (see FIG. 3) are formed in wall 14 of capsule 12. Apertures 20 and 22 are aligned with each other and opposite each other so that a free end 24 of a flexible wire 26 may be passed therethrough, traversing open space 19.

Flexible wire 26 is permanently connected to security seal 10. Preferably, flexible wire 26 is formed integrally with seal 10. In the most preferred embodiment, flexible wire 26 is integrally formed with capsule 12 at a bottom surface 28 thereof.

Figure 2:
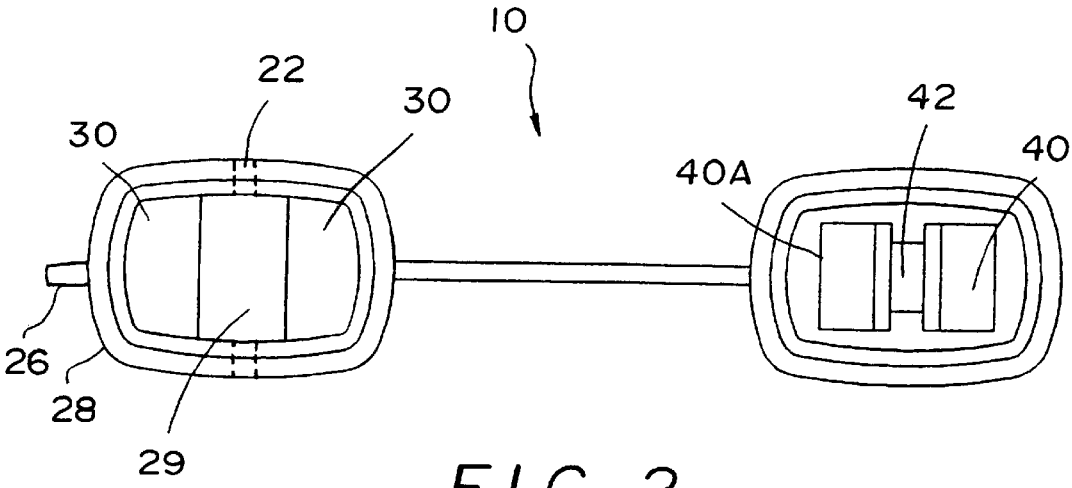
FIG. 2 is a plan view of the seal in an unlocked condition.
Figure 4:
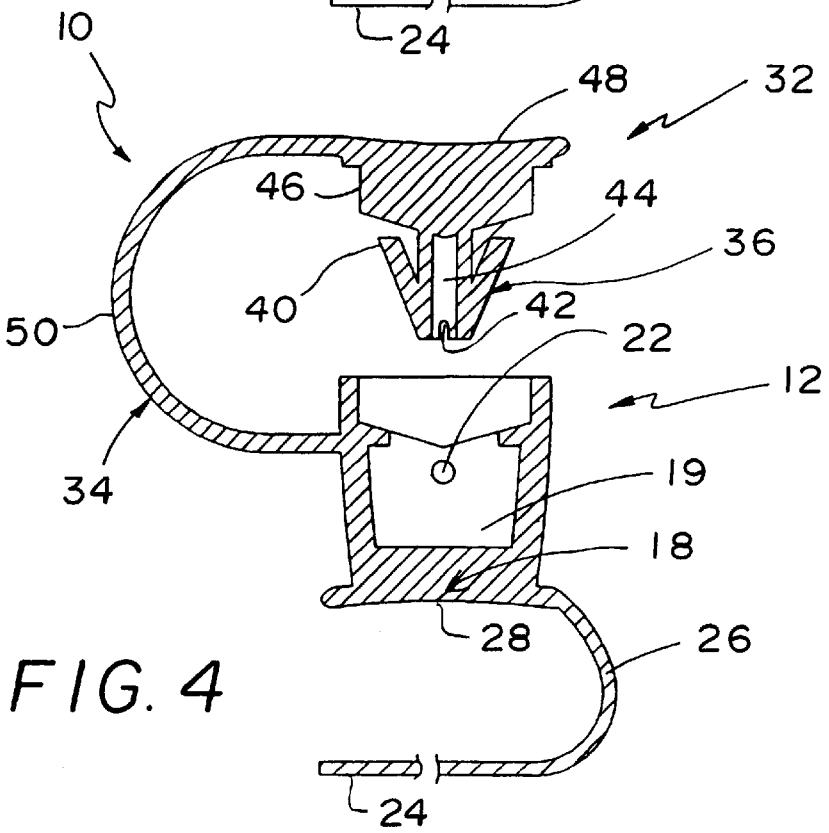
FIG. 4 is a section view of the seal according to FIG. 3.

As shown in FIGS. 2 and 4, capsule 12 includes a first connection fitting 30 formed therein adjacent space 19. According to the embodiments shown, first connection fitting 30 is a female fitting; however, the present invention contemplates a male fitting as well. Moreover, the term connection fitting used in this description is considered to encompass any arrangement of fittings which cooperate to form an irreversible connection as described hereafter.

Referring again to FIG. 1, seal 10 also includes a locking member 32 which is connected to capsule 12 by a flexible connecting arm 34. Flexible connecting arm 34 is preferably integrally formed with capsule 12 and locking member 32.

Locking member 32 includes an insertion end 36 which is insertable into open end 16 of capsule 12 into space 19. As shown in FIG. 6, when insertion end 36 is inserted into capsule 12, a bent path 38 is created between locking member 32 and capsule 12. Insertion end 36 includes a second connection fitting 40 which is designed to cooperate with first connection fitting 30 of capsule 12 to provide an irreversible connection between locking member 32 and capsule 12 when insertion end 36 is inserted therein.

In the embodiments shown, second connection fitting 40 is a male fitting. The male/female fitting arrangement described and shown is for illustration purposes only. As mentioned above, various connection fittings are contemplated by the present invention for providing the irreversible connection between locking member 32 and capsule 12.

According to a preferred embodiment, insertion end 36 includes a groove 42 formed in a leading tip thereof. Groove 42 is designed to engage flexible wire 26 when seal 10 is being locked.

Figure 3:
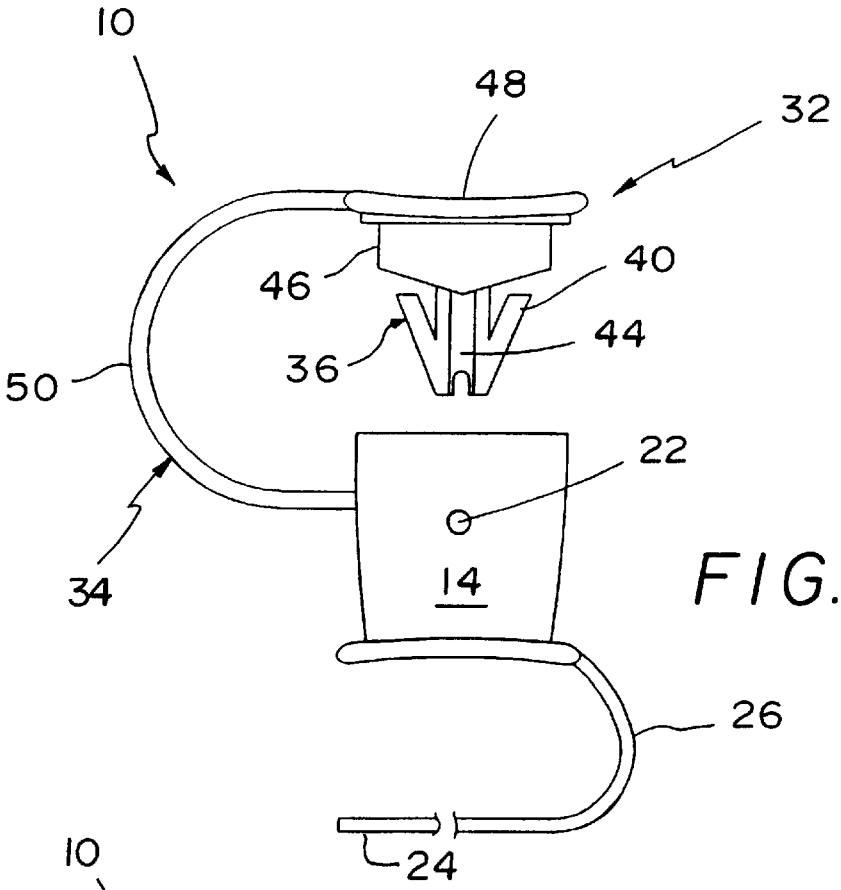
FIG. 3 is a rear elevation view of another embodiment of the seal in which the locking member is connected to the capsule by an integral arm having a bend.

FIGS. 3 and 4 show a flexible connection arm 34 that is semi-rigid and is formed with a bend towards the capsule 12, with the bend positioning the locking member 32 at a distance relative to the capsule 12. As shown in FIGS. 3 and 4, the longitudinal lengths of the channel 44 and the bore portion 46 of the insertion end of the locking member 32 approximately equals an insertable length of the locking member 32 that can be inserted into the capsule 12. The insertable width is approximately the lateral thickness of the insertion end 36, more clearly shown in FIG. 2, or the distance between the outwardly opposing edges 40A of the two second connection fittings 40. In FIGS. 3 and 4, the insertion end 36 is shown at a position such that the distance between the insertion end 36 and the capsule 12 is not substantially greater than the insertable length or insertable width of the insertion end 36, in order to optimally facilitate the insertion of the insertion end 36 of the locking member 32 into the capsule 12.

Also according to a preferred embodiment, insertion end 36 includes a channel 44 formed on each side. Channels 44 are aligned with first and second apertures 20 and 22, respectively, when insertion end 36 is inserted into open end 16 of capsule 12 such that channels 44 form at least a portion of bent path 38. When groove 42 is provided in insertion end 36, channels 44 are also aligned therewith and groove 42 also forms a portion of bent path 38 (see FIG. 6) when seal 10 is locked.

Insertion end 36 may also include a base portion 46. Base portion 46 completely closes open end 16 of capsule 12 when seal 10 is locked. This may be accomplished by forming open end 16 in a shape which corresponds to the shape of base portion 46 such that base portion 46 mates with open end 16 when seal 10 is locked.

According to a preferred embodiment, locking member 32 includes a top surface which covers a surface area larger than open end 16 of capsule 12. Preferably, top surface 48 fits substantially flush against capsule 12 at open end 16 and extends substantially perpendicularly beyond wall 14 of capsule 12 when seal 10 is locked. Providing locking member 32 with top surface 48, preferably with base portion 46, prevents tampering by denying access through open end 16 when seal 10 is locked.

In accordance with the superior ergonomic design of seal 10, top surface 48 and bottom surface 28 are preferably shaped to conform to a digit of a user. For example, as shown in the figures, top surface 48 and bottom surface 28 may be curved with a slight concavity. Also, notwithstanding the design of top surface 48 for anti-tampering purposes, top and bottom surfaces 48, 28 are preferably formed to provide a larger surface area for pressing by digits of a user when the overall size of seal 10 is relatively small.

The operation of seal 10 is as follows. First, free end 24 of flexible wire 26 is passed through first aperture 20 and second aperture 22. Then, insertion end 36 of locking member 32 is inserted into open end 16 of capsule 12. Insertion end 36, by groove 42 if provided, engages flexible wire 26 and forces flexible wire 26 into capsule 12 therewith. The insertion of insertion end 36 into capsule 12 creates bent path 38 with which flexible wire 26 is forced to conform. This forms a plurality of crimps in flexible wire 26 whereby flexible wire 26 is secured between capsule 12 and locking member 32. If channels 44 are provided on the sides of insertion end 36, channels 44 provide further guidance of flexible wire 26 into bent path 38 which is at least partially created thereby. Second connection fitting 40 is irreversibly engaged by first connection fitting 30 when insertion end 36 is fully inserted into capsule 12. Thus, an irreversible connection is made between locking member 32 and capsule 12 with flexible wire 26 held securely therebetween in bent path 38.

Because of the unique design of the one-piece security seal according to the present invention, the locking operation of seal 10 is simple and permanent. Seal 10 may be easily locked with one hand only and with gloved hands. To further facilitate easy locking, flexible connecting arm 34 may include a bend 50 as shown in FIG. 3. Bend 50, of course, is not limited to the embodiment shown in FIG. 3, but contemplates a bend which is formed as an angle.

The one-piece security seal according to the present invention is preferably injection molded of plastic with the flexible wire being integrally molded with a portion thereof.

The present invention is by no means restricted to the above-described preferred embodiments, but covers all variations that might be implemented by using equivalent functional elements or devices that would be apparent to a person skilled in the art, or modifications that fall within the spirit and scope of the appended claims.

It will be understood that a number of variations or modifications may be made within the basic concept of the present invention. For example, channel 44 may be formed inside capsule 12 rather than on the sides of insertion end 36 of locking member 32. In that case, first and second channels 44 are formed inside capsule 12 aligned with first and second apertures 20, 22 and extending to closed end 18. The present invention contemplates also variations or modifications within the scope of the following claims and should not be limited to the specific embodiments disclosed above.

What is claimed is:

1. A one-piece security seal, comprising:

a capsule having a wall with an inner surface, said wall defining an open end, a closed end, and an interior space between said open and closed ends, said capsule including a first connection fitting formed therein adjacent said interior space;

a first aperture formed in said wall of said capsule and opening into said interior space;

a second aperture formed in said wall of said capsule, said second aperture being aligned with and opposite said first aperture to form an axis through the centers of the apertures, and opening into said interior space;

said apertures arranged to receive a filament adapted to be passed therethrough;

a locking member having an insertion end which is insertable into said open end of said capsule, said insertion end including a second connection fitting which engages said first connection fitting of said capsule to provide an irreversible connection between said locking member and said capsule when said insertion end is inserted therein to place said security seal in a locked condition such that said locking member cannot be non-destructively removed from said capsule;

a channel formed on an outer side of said insertion end of said locking member, said channel being aligned with said first and second apertures, respectively, when said insertion end is inserted into said open end of said capsule through the axis formed by the apertures such that said channel forms at least a portion of an angularly bent path for the filament passing through the apertures in said interior space created between said outer surface of said locking member and said inner surface of said capsule; and a flexible connecting arm connecting said capsule and said locking member.

2. The one-piece security seal according to claim 1, wherein said flexible connecting arm is semi-rigid and is formed with a bend towards said capsule, said bend positioning said locking member relative to said capsule such that a distance between said insertion end and said capsule is less than an insertable length of said insertion end so as to facilitate insertion of said insertion end of said locking member into said capsule.

3. The one-piece security seal according to claim 1, wherein said flexible connecting arm is semi-rigid and is formed with a bend towards said capsule, said bend positioning said locking member relative to said capsule such that a distance between said insertion end and said capsule is less than an insertable width of said insertion end so as to facilitate insertion of said insertion end of said locking member into said capsule.

4. A one-piece security seal, comprising:

a capsule having a wall with an inner surface, said wall defining an open end, a closed end, and an interior space between said open and closed ends, said capsule including a first connection fitting formed therein adjacent said interior space;

a first aperture formed in said wall of said capsule and opening into said interior space;

a second aperture formed in said wall of said capsule, said second aperture being aligned with and opposite said first aperture, and opening into said interior space;

said apertures arranged to receive a filament passed therethrough;

a locking member having an insertion end which is insertable into said open end of said capsule, said insertion end including a second connection fitting which engages said first connection fitting of said capsule to provide an irreversible connection between said locking member and said capsule when said insertion end is inserted therein to place said security seal in a locked condition such that said locking member cannot be non-destructively removed from said capsule;

a channel formed on an outer side of said insertion end of said locking member, said channel being aligned with said first and second apertures, respectively, when said insertion end is inserted into said open end of said capsule such that said channel forms at least a portion of an angularly bent path for the filament passing through the apertures in said interior space created between said outer surface of said locking member and said inner surface of said capsule;

a flexible connecting arm connecting said capsule and said locking member; and wherein said locking member includes a top surface and said capsule includes a bottom surface, said top and bottom surfaces each having a slightly inwardly concave contour.

5. A one-piece security seal, comprising:

a capsule having a wall with an inner surface, said wall defining an open end, a closed end, and an interior space between said open and closed ends, said capsule including a first connection fitting formed therein adjacent said interior space;

a first aperture formed in said wall of said capsule and opening into said interior space;

a second aperture formed in said wall of said capsule, said second aperture being aligned with and opposite said first aperture, and opening into said interior space;

said apertures arranged to receive a filament passed therethrough;

a locking member having an insertion end which is insertable into said open end of said capsule, said insertion end including a second connection fitting which engages said first connection fitting of said capsule to provide an irreversible connection between said locking member and said capsule when said insertion end is inserted therein to place said security seal in a locked condition such that said locking member cannot be non-destructively removed from said capsule;

a channel formed on an outer side of said insertion end of said locking member, said channel being aligned with said first and second apertures, respectively, when said insertion end is inserted into said open end of said capsule such that said channel forms at least a portion of an angularly bent path for the filament passing through the apertures in said interior space created between said outer surface of said locking member and said inner surface of said capsule;

a flexible connecting arm connecting said capsule and said locking member; and wherein said locking member includes a top surface and said capsule includes a bottom surface, said top and bottom surfaces each extending over a surface area that is greater than a cross-sectional area of said capsule taken along a plane substantially parallel to said bottom surface of said capsule.

6. The one-piece security seal according to claim 5, wherein said top and bottom surfaces each have a slightly inwardly concave contour.

7. A one-piece security seal, comprising:

a capsule having a wall with an inner surface, said wall defining an open end, a closed end, and an interior space between said open and closed ends, said capsule including a first connection fitting formed therein adjacent said interior space;

a first aperture formed in said wall of said capsule and opening into said interior space;

a second aperture formed in said wall of said capsule, said second aperture being aligned with and opposite said first aperture, and opening into said interior space;

said apertures arranged to receive a filament passed therethrough;

a locking member having an insertion end which is insertable into said open end of said capsule, said insertion end including a second connection fitting which engages said first connection fitting of said capsule to provide an irreversible connection between said locking member and said capsule when said insertion end is inserted therein to place said security seal in a locked condition such that said locking member cannot be non-destructively removed from said capsule;

a channel formed on an outer side of said insertion end of said locking member, said channel being aligned with said first and second apertures, respectively, when said insertion end is inserted into said open end of said capsule such that said channel forms at least a portion of an angularly bent path for the filament passing through the apertures in said interior space created between said outer surface of said locking member and said inner surface of said capsule;

a flexible connecting arm connecting said capsule and said locking member; and a groove formed in a leading tip of said insertion end of said locking member, said groove being aligned with said channel and adapted to engage a filament passed through both of said apertures across said interior space such that the filament will be self-threaded into said channel when said insertion end is inserted into said capsule to place said security seal in the locked condition.

8. A one-piece security seal, comprising:

a capsule having a wall with an inner surface, said wall defining an open end, a closed end, and an interior space between said open and closed ends, said capsule including a first connection fitting formed therein adjacent said interior space;

a first aperture formed in said wall of said capsule and opening into said interior space;

a second aperture formed in said wall of said capsule, said second aperture being aligned with and opposite said first aperture, and opening into said interior space;

said apertures arranged to receive a filament passed therethrough;

a locking member having an insertion end which is insertable into said open end of said capsule, said insertion end including a second connection fitting which engages said first connection fitting of said capsule to provide an irreversible connection between said locking member and said capsule when said insertion end is inserted therein to place said security seal in a locked condition such that said locking member cannot be non-destructively removed from said capsule;

a channel formed on an outer side of said insertion end of said locking member, said channel being aligned with said first and second apertures, respectively, when said insertion end is inserted into said open end of said capsule such that said channel forms at least a portion of an angularly bent path for the filament passing through the apertures in said interior space created between said outer surface of said locking member and said inner surface of said capsule;

a flexible connecting arm connecting said capsule and said locking member; and a filament comprising a flexible wire which is integral with said security seal and extends therefrom with a free end, said free end of said flexible wire being arranged to pass through both of said apertures across said interior space such that said flexible wire is guided into said angularly bent path by said channel when said insertion end is inserted into said open end of said capsule.

9. The one-piece security seal according to claim 8, further comprising:

a groove formed in a leading tip of said insertion end of said locking member, said groove being aligned with said channel and adapted to engage said flexible wire such that said flexible wire is self-threaded into said channel when said insertion end is inserted into said capsule to place said security seal in the locked condition.

10. A one-piece security seal, comprising:

a capsule having a wall with an inner surface, said wall defining an open end, a closed end, and an interior space between said open and closed ends, said capsule including a first connection fitting formed therein adjacent said interior space;

a first aperture formed in said wall of said capsule and opening into said interior space;

a second aperture formed in said wall of said capsule, said second aperture being aligned with and opposite said first aperture, and opening into said interior space;

said apertures arranged to receive a filament passed therethrough;

a locking member having an insertion end which is insertable into said open end of said capsule, said insertion end including a second connection fitting which engages said first connection fitting of said capsule to provide an irreversible connection between said locking member and said capsule when said insertion end is inserted therein to place said security seal in a locked condition such that said locking member cannot be non-destructively removed from said capsule;

a channel formed on an outer side of said insertion end of said locking member, said channel being aligned with said first and second apertures, respectively, when said insertion end is inserted into said open end of said capsule such that said channel forms at least a portion of an angularly bent path for the filament passing through the apertures in said interior space created between said outer surface of said locking member and said inner surface of said capsule;

a flexible connecting arm connecting said capsule and said locking member; and a filament comprising a flexible wire which is formed integrally with said capsule and extends therefrom with a free end, said free end of said flexible wire being arranged to pass through both of said apertures across said interior space such that said flexible wire is guided into said angularly bent path by said channel when said insertion end is inserted into said open end of said capsule.

11. The one-piece security seal according to claim 10, further comprising:

a groove formed in a leading tip of said insertion end of said locking member, said groove being aligned with said channel and adapted to engage said flexible wire such that said flexible wire is self-threaded into said channel when said insertion end is inserted into said capsule to place said security seal in the locked condition.

12. A one-piece security seal, comprising:

a capsule having a wall with an inner surface, said wall defining an open end, a closed end, and an interior space between said open and closed ends, said capsule including a first connection fitting formed therein adjacent said interior space;

a first aperture formed in said wall of said capsule and opening into said interior space;

a second aperture formed in said wall of said capsule, said second aperture being aligned with and opposite said first aperture, and opening into said interior space;

said apertures arranged to receive a filament passed therethrough;

a locking member having an insertion end which is insertable into said open end of said capsule, said insertion end including a second connection fitting which engages said first connection fitting of said capsule to provide an irreversible connection between said locking member and said capsule when said insertion end is inserted therein to place said security seal in a locked condition such that said locking member cannot be non-destructively removed from said capsule;

a channel formed on an outer side of said insertion end of said locking member, said channel being aligned with said first and second apertures, respectively, when said insertion end is inserted into said open end of said capsule such that said channel forms at least a portion of an angularly bent path for the filament passing through the apertures in said interior space created between said outer surface of said locking member and said inner surface of said capsule;

a flexible connecting arm connecting said capsule and said locking member; and a filament comprising a flexible wire which is permanently connected to said security seal and extends therefrom with a free end, said free end of said flexible wire being arranged to pass through both of said apertures across said interior space such that said flexible wire is guided into said angularly bent path by said channel when said insertion end is inserted into said open end of said capsule.

13. The one-piece security seal according to claim 12, further comprising:

a groove formed in a leading tip of said insertion end of said locking member, said groove being aligned with said channel and adapted to engage said flexible wire such that said flexible wire is self-threaded into said channel when said insertion end is inserted into said capsule to place said security seal in the locked condition.

14. A one-piece security seal, comprising:

a capsule having a wall with an inner surface, said wall defining an open end, a closed end, and an interior space between said open and closed ends, said capsule including a first connection fitting formed therein adjacent said interior space;

a first aperture formed in said wall of said capsule and opening into said interior space;

a second aperture formed in said wall of said capsule, said second aperture being aligned with and opposite said first aperture, and opening into said interior space;

said apertures arranged to receive a filament passed therethrough;

a locking member having an insertion end which is insertable into said open end of said capsule, said insertion end including a second connection fitting which engages said first connection fitting of said capsule to provide an irreversible connection between said locking member and said capsule when said insertion end is inserted therein to place said security seal in a locked condition such that said locking member cannot be non-destructively removed from said capsule;

a channel formed on an outer side of said insertion end of said locking member, said channel being aligned with said first and second apertures, respectively, when said insertion end is inserted into said open end of said capsule such that said channel forms at least a portion of an angularly bent path for the filament passing through the apertures in said interior space created between said outer surface of said locking member and said inner surface of said capsule;

a flexible connecting arm connecting said capsule and said locking member; and wherein said locking member includes a top portion which extends over a surface area larger than said open end of said capsule such that the top portion extends substantially perpendicularly beyond said wall of said capsule with said top portion fitting substantially flush against said capsule at said open end when said insertion end is inserted into said capsule to place said security seal in the locked condition.

15. A one-piece security seal, comprising:

a capsule having a wall with an inner surface, said wall defining an open end, a closed end, and an interior space between said open and closed ends, said capsule including a first connection fitting formed therein adjacent said interior space;

a first aperture formed in said wall of said capsule and opening into said interior space;

a second aperture formed in said wall of said capsule, said second aperture being aligned with and opposite said first aperture, and opening into said interior space;

said apertures arranged to receive a filament passed therethrough;

a locking member having an insertion end which is insertable into said open end of said capsule, said insertion end including a second connection fitting which engages said first connection fitting of said capsule to provide an irreversible connection between said locking member and said capsule when said insertion end is inserted therein to place said security seal in a locked condition such that said locking member cannot be non-destructively removed from said capsule;

a channel formed on an outer side of said insertion end of said locking member, said channel being aligned with said first and second apertures, respectively, when said insertion end is inserted into said open end of said capsule such that said channel forms at least a portion of an angularly bent path for the filament passing through the apertures in said interior space created between said outer surface of said locking member and said inner surface of said capsule;

a flexible connecting arm connecting said capsule and said locking member; and wherein said first connection fitting is a female fitting and said second connection fitting is a male fitting.

16. A one-piece security seal, comprising:

a capsule having a wall with an inner surface, said wall defining an open end, a closed end, and an interior space between said open and closed ends, said capsule including a first connection fitting formed therein adjacent said interior space;

a first aperture formed in said wall of said capsule and opening into said interior space;

a second aperture formed in said wall of said capsule, said second aperture being aligned with and opposite said first aperture, and opening into said interior space;

said apertures arranged to receive a filament passed therethrough;

a locking member having an insertion end which is insertable into said open end of said capsule, said insertion end including a second connection fitting which engages said first connection fitting of said capsule to provide an irreversible connection between said locking member and said capsule when said insertion end is inserted therein to place said security seal in a locked condition such that said locking member cannot be non-destructively removed from said capsule;

a channel formed on an outer side of said insertion end of said locking member, said channel being aligned with said first and second apertures, respectively, when said insertion end is inserted into said open end of said capsule such that said channel forms at least a portion of an angularly bent path for the filament passing through the apertures in said interior space created between said outer surface of said locking member and said inner surface of said capsule;

a flexible connecting arm connecting said capsule and said locking member; and wherein said insertion end of said locking member includes a base portion which extends into said capsule so as to completely close said open end of said capsule when said insertion end is inserted into said capsule to place said security seal in the locked condition.

17. The one-piece security seal according to claim 16, wherein said base portion of said insertion end includes a top portion which extends over a surface area larger than said open end of said capsule such that the top portion extends substantially perpendicularly beyond said wall of said capsule with said top portion fitting substantially flush against said capsule at said open end when said insertion end is inserted into said capsule to place said security seal in the locked condition.

18. A one-piece security seal, comprising:

a capsule having a wall with an inner surface, said wall defining an open end, a closed end, and an interior space between said open and closed ends, said capsule including a first connection fitting formed therein adjacent said interior space;

a first aperture formed in said wall of said capsule and opening into said interior space;

a second aperture formed in said wall of said capsule, said second aperture being aligned with and opposite said first aperture to form an axis through the centers of the apertures, and opening into said interior space;

said apertures adapted to receive a wire passed therethrough;

a locking member having an insertion end which is insertable into said open end of said capsule, said insertion end including a second connection fitting which engages said first connection fitting of said capsule to provide an irreversible connection between said locking member and said capsule when said insertion end is inserted therein to place said security seal in a locked condition such that said locking member cannot be non-destructively removed from said capsule;

a groove formed in a leading tip of said insertion end of said locking member, the leading tip of said insertion end extending through the axis formed by the apertures when the insertion end is inserted into the capsule, said groove being aligned with said apertures and engageable to a wire passed through both of said apertures across said interior space such that the wire will be self-threaded into said channel when said insertion end is inserted into said capsule to place said security seal in the locked condition; and a flexible connecting arm connecting said capsule and said locking member.

* * * * *